United States Patent [19]

Leschonski et al.

[11] Patent Number: 4,573,801

[45] Date of Patent: Mar. 4, 1986

[54] APPARATUS FOR PRODUCING A GAS SOLID TWO PHASE FLOW JET HAVING A CONSTANT MASS OR VOLUME FLOW RATE AND PREDETERMINED VELOCITY

[76] Inventors: Kurt Leschonski, Am Dammgraben 20; Stephan Röthele, Am Rollberg 5, both of 3392 Clausthal-Zellerfeld, Fed. Rep. of Germany

[21] Appl. No.: 583,675

[22] Filed: Feb. 27, 1984

[30] Foreign Application Priority Data

Mar. 2, 1983 [DE] Fed. Rep. of Germany ..... 3307406

[51] Int. Cl.[4] ..... B01F 15/02

[52] U.S. Cl. ..... 366/154; 366/163; 366/176; 366/182; 366/191; 366/337; 118/308; 222/630

[58] Field of Search ..... 366/10–12, 366/16, 30, 33, 76, 163, 101, 107, 154, 160, 162, 182, 336–340, 341, 176, 349, 197; 118/308; 222/630

[56] References Cited

U.S. PATENT DOCUMENTS

| | | | |
|---|---|---|---|
| 2,878,972 | 3/1959 | Matthews | 118/308 X |
| 3,488,699 | 1/1970 | Lee et al. | 366/176 X |
| 3,506,244 | 4/1970 | Strang | 366/176 |
| 3,707,829 | 1/1973 | Siegel | 366/154 X |
| 3,770,249 | 11/1973 | Schmitt | 366/336 |
| 3,874,643 | 4/1975 | Lorenian et al. | 366/182 X |
| 4,299,655 | 11/1981 | Skaugen | 366/336 X |
| 4,334,783 | 6/1975 | Suzaka | 366/341 X |

*Primary Examiner*—Timothy F. Simone
*Attorney, Agent, or Firm*—Kenyon & Kenyon

[57] ABSTRACT

In a method of and an apparatus for producing a gas-solid free jet (7) of constant mass or volume flow rate, in which jet the solid particles having a particle size particularly smaller than 50 μm are dispersed completely and uniformly, a consolidated or compressed solid particle mass flow (8) of constant density and constant cross section is produced with the aid of a rotating metering groove (2) and subsequently sucked entirely into a closed flow channel to be accelerated and dispersed in an injector (9). The resulting gas solid particle mixture is discharged out of the flow channel as a free jet (7). Dispersing, particularly of very fine particles (up to a few μm) is promoted until practically complete by directing the gas-solid particle mixture against at least one impact surface (17), in particular against a plurality of obliquely disposed impact surfaces arranged offset in zig-zag fashion one behind the other so as to be impinged upon successively (impact surface cascade (15)) and only then discharging the mixture out of the flow channel.

22 Claims, 23 Drawing Figures

APPARATUS FOR PRODUCING A GAS SOLID TWO PHASE FLOW JET HAVING A CONSTANT MASS OR VOLUME FLOW RATE AND PREDETERMINED VELOCITY

BACKGROUND OF THE INVENTION

1. Field of the Invention

The instant invention relates to a method of and an apparatus for producing a gas-solid two phase flow jet having a constant mass or volume flow rate and predetermined velocity, in which free jet the solid particles are dispersed completely and uniformly.

2. The Prior Art

Feeding or metering dispersing devices are needed to generate gas-solid two phase flow jets of constant mass or volume flow rate wherever the dry processing of fine particle deposits requires that first these particles be picked up mechanically and then supplied or fed at constant mass or volume flow rate to a unit operation for which it is a condition that the particles be dispersed in defined manner. Examples of corresponding technical usage are the loading of wind sifters, the generation of gas-solid two phase flows, the measuring of particle size distributions based on the analysis of field effects in the gas-solid free jet, mechanical coating processes with which, for instance, a gas-solid jet is to be supplied at predetermined mass flow rate and fixed particle velocities to a surface which is prepared for a melt coating procedure, and the production of test aerosols. Production of the latter is much more sophisticated than the production of technical aerosols by conventional aerosol generators. The significant difference lies in the high mass flow rate required which is much higher for the applications described than the mass flow rate obtained with the known aerosol generators. To disperse fine solid particles which have agglomerated, it is attempted to disintegrate the agglomerates by forces of flow, particle-particle impacts, and particle-wall impacts. In the known dispersing means the material is subjected to all these stresses at the same time, but to different degrees.

The particle size range requiring measures to be taken for dispersing the particles begins approximately at 50 μm. As the particles become finer, the measures become more sophisticated because the forces of adhesion acting among the particles increase at decreasing particle size. At particle sizes below 10 μm full dispersion and disintegration of the particles become especially difficult.

Thus it is impossible to produce gas-solid particle free jets of constant mass or volume flow rate with the known metering dispersing devices if the solid particle size is below approximately 50 μm.

SUMMARY OF THE PRESENT INVENTION

It is, therefore, an object of the invention to provide a method by which a gas-solid free jet of constant mass or volume flow rate can be produced in which jet the particles of a size of from below approximately 50 μm to several micrometers are fully dispersed. It is also an object of the present invention to provide an apparatus for carrying out the method of producing the two phase jet as defined.

The method of the present invention comprises a plurality of steps. First of all, a compressed or consolidated solid particle mass flow of constant cross section is formed which then is taken up completely by a gas in a closed flow channel. In the flow channel the solid particles are accelerated and fully dispersed. Then the resulting gas-solid particle mixture is discharged as a free jet out of the flow channel or dispersing channel. It is provided, in accordance with the present invention, the prior to this discharge out of the flow channel the mixture of gas and solid particles is directed several times against impact surfaces so as to obtain full dispersion and consequently a constant character of the mass or volume flow rate. In this manner the agglomerates are positively split up into their individual particles which return at once into the gas flow and, therefore, cannot precipitate or deposit.

In a preferred embodiment of the method it is provided that the mixture is directed against impact surfaces in a zig-zag path before being dispensed out of the flow channel. Instead or in addition, the gas-solid particle mixtures also may be passed across an impact surface cascade composed of a plurality of impact surfaces which are inclined alternatingly to one side or the other.

Mechanical loosening or predispersing of the consolidated solid particle mass flow could be expedient just before the flow is received by or sucked into the dispersing channel.

It is proposed, in accordance with the present invention, that the method be carried out by a metering-dispersing apparatus for producing a gas-solid-two phase flow jet having a constant mass or volume flow rate and predetermined velocity. This apparatus comprises:

- a metering groove which is rotatable about an axis and has the cross section of the solid particle mass flow to be created,
- a metering means for the solid particles to be fed, which particularly includes a vibrating feeder chute having its dispensing location spaced above the metering groove,
- a wiper means which is disposed downstream of the dispensing location of the metering means in the direction of rotation of the metering groove and the distance of which from the metering groove is adjustable for the selected removal of surplus solids,
- a compressing means, particularly a compressing roll which is disposed downstream of the wiper means in the direction of rotation of the metering groove and which uniformly and lightly compresses the solid particles in the metering groove,
- a flow channel which includes an injector and has a suction mouth immersed in the metering groove downstream of the compressing means in the direction of rotation of the metering groove and which comprises a dispersing means located behind the injector and before an outlet nozzle for the gas-solid particle mixture. In the dispersing means and upstream of the outlet nozzle there are, in accordance with the present invention, a plurality of consecutive impact surfaces on which the gas-solid particle mixture impinges one after the other. Preferably the impact surfaces are arranged as an impact surface cascade of zig-zag outline. The outline may be asymmetrical.

Conveniently the reception of the compressed particles in the suction mouth of the flow channel is enhanced by a mechanical predispersing means, particularly in the form of a revolving brush which may be assisted, if desired, by a gas supply means or inlet.

In another modification of the apparatus it is provided that the injector of the flow channel comprises a central tube disposed in a propelling gas chamber which surrounds the injector. This tube ends spaced from a converging entry nozzle and opens into an annular gap. The dispersing means including the impact surfaces is disposed downstream of the nozzle.

The spacing between the mouth of the central tube and the entry nozzle preferably is variable between a few millimeter and several tenths of a millimeter. To achieve this spacing, the central tube may be supported for longitudinal displacement. In this manner the degree of dispersion of the particles in the gas stream may be varied and adjusted before the impact surfaces are hit.

With this apparatus it is possible to produce a constant mass or volume flow rate of solid particles, and this solid particle flow is dispersed fully and uniformly in the carrier gas, not leaving behind any agglomerates, and is then discharged as a free jet of a gas-solid-two phase flow.

The metering groove may be provided in carriers of different design.

In a first embodiment of the apparatus according to the present invention the metering groove is designed as an upwardly open groove formed in the top surface of a rotary plate which is rotatable about a vertical axis. The metering groove is located at the edge of the rotary plate, preferably in a wide ring which extends in upward direction.

In a second embodiment of the apparatus according to the present invention the metering groove is formed in the inside of a wheel rim which is rotatable about a horizontal axis of rotation. The metering groove faces the axis of rotation.

The wheel rim may be driven at such speed that the centrifugal force will keep the solid particles delivered entirely in the metering groove. The solid particles may then be withdrawn from the metering groove at any desired location, either directly or by the predispersing means.

The wheel rim also may be driven at a slightly lower but still sufficiently high number of revolutions for the solid particles to be taken along just about to the vertex where they separate from the metering groove to be transferred directly into the suction mouth of the flow channel.

Finally, the wheel rim may be driven at a still lower number of revolutions which yet is high enough for the solid particles to pour like a cataract out of the metering groove and fall freely into a collecting funnel disposed at the suction mouth of the flow channel.

With all these modifications of the apparatus it is convenient for the metering groove to be furnished with transverse webs which will assist in the conveyance of the solid particles.

The material to be treated or the solid particles may be supplied by a conventional mechanical feeding or metering apparatus and be fed through a conveying chute to the turntable or plate which is rotatable about a vertical axis of rotation. This type of feeding also may be applied when the metering groove is disposed at the inner side of a wheel rim.

It proved to be especially advantageous to supply the material to the wheel rim by means of a fluidized bed. To this end, a fluidized bed apparatus has a fluidized bed chamber which is open at the top and into which the wheel rim becomes immersed with its respective lower segment to such a degree that the metering groove becomes filled from the side. In this case predispersing is achieved in the fluidized bed.

In accordance with a third modification of the apparatus according to the present invention the metering groove is formed in the outer surface of an endless conveyor belt revolving around two guide rollers which are supported horizontally spaced from each other. The wiper means, the compressing means, and a suction mouth of the flow channel cooperate with the upper horizontal run of the conveyor belt. For this purpose the guide rollers are disposed sufficiently far apart and the conveyor belt is given appropriate length.

It is an advantage of the two embodiments of the metering groove at the inside of the wheel rim and at the outside of the conveyor belt, respectively, that the grooves means are narrow transversely of the direction of their movement. This makes it easy to combine several apparatus in a multiple assembly so as to generate a very extensive, wide, uninterrupted gas-solid flat jet which is of little height. Thus it is provided with a modification of these two apparatus to arrange a plurality of feeding-dispersing devices in parallel side-by-side relation to order to generate such a wide free or flat jet. These devices are so arranged that the issuing free jets combine at a certain distance from the plane of the openings of the outlet nozzles to form a wide flat jet. Such an apparatus may be used to produce accurately continuous coatings across great widths.

With a modified embodiment the feeding of any excess material into a rotating metering groove may be dispensed with and instead a wide flat jet may be generated directly. To achieve that, the flow channel comprising the suction channel, the injector, and the impact surfaces is designed to be flat. In other words, the cross section of the flow channel instead of being circular is rectangular and has the width and minor heigth of the flat jet to be produced. The material fed directly from a fluidized bed duct into the suction mouth of a flow channel, the length of the duct corresponding to the width of the suction channel. The fluidized bed duct is an elongated channel which is open at the top and has upper and lower portions divided by a screen to which the carrier fluid (gas or air) introduced into the lower portion flows in upward direction. Above the screen one side wall of the fluidized bed duct is formed with an elongated slot through which the pre-dispersed particles are sucked directly into the suction mouth of the flow channel. A broad flat jet leaves the outlet nozzle of the impact surface cascade, and this flat jet is homogeneous as soon as it has left the outlet.

BRIEF DESCRIPTION OF THE DRAWING

The invention will be described further, by way of example of a metering-dispersing apparatus, with reference to the accompanying drawings, in which.

DESCRIPTION OF THE PREFERRED EMBODIMENTS

With the first embodiment of a metering-dispersing apparatus as shown in FIGS. 1 to 4 an upwardly open, annular metering groove 2 is formed in an upwardly extending ring along the outer edge of a rotary plate 10 which is rotatable about a vertical axis. A constant mass or volume flow of solid particles is fed to the metering groove 2 by a vibrating feeder chute 1 of a vibration metering means 22. The constancy of this flow of material is to be improved on the rotary plate.

Figure 1:
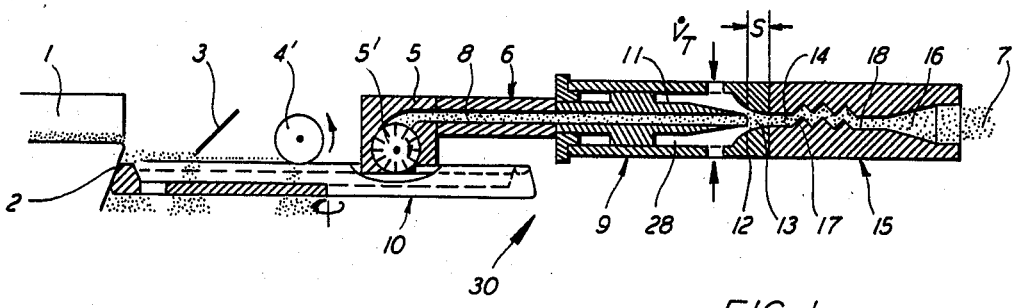
FIG. 1 is a functional diagram similar to a side elevational view of a first embodiment of a metering-dispersing apparatus.
Figure 2:
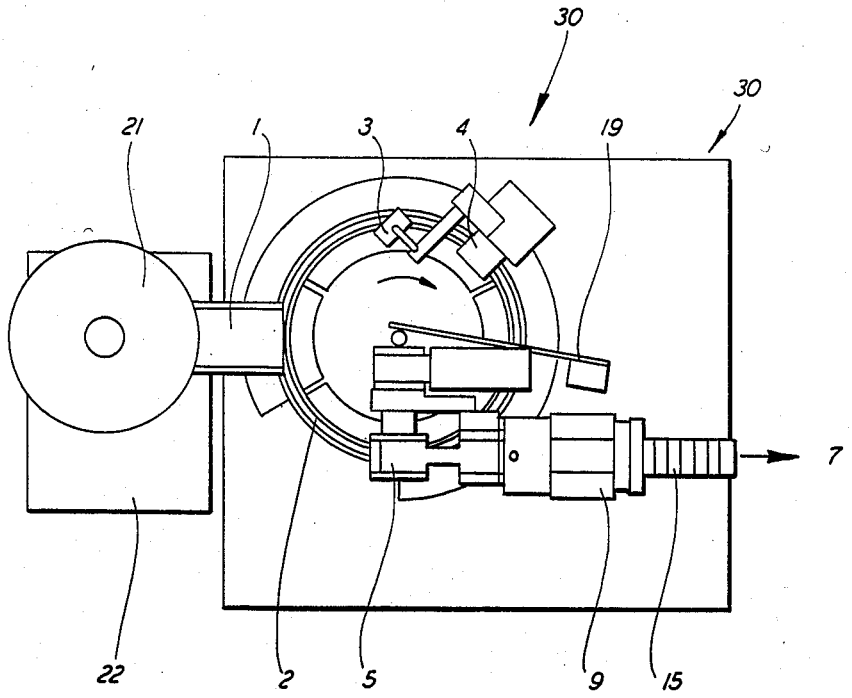
FIG. 2 is a top plan view of the metering-dispersing apparatus shown in FIG. 1, including the means disposed above the metering groove.
Figure 4:
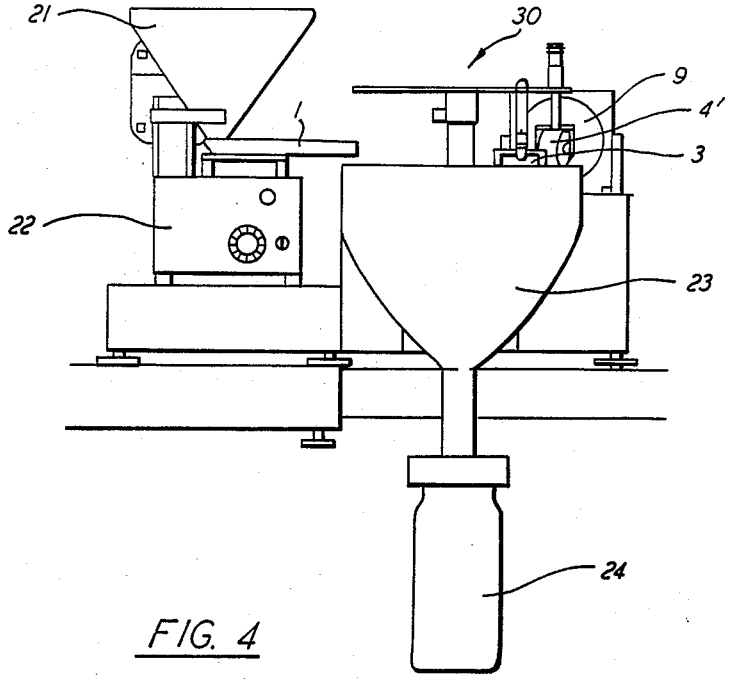
FIG. 4 is an elevational view of the apparatus shown in FIG. 3.
Figure 5:
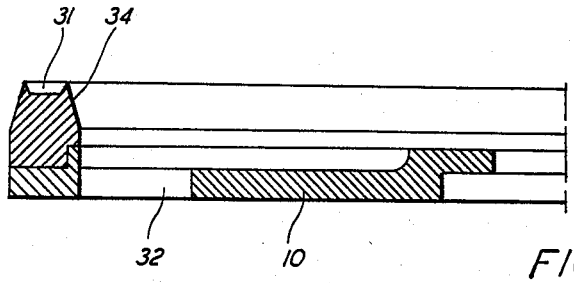
FIG. 5 is an enlarged cross sectional presentation of one half of the rotary plate shown in FIG. 1.

At the inside of the metering groove 2 the rotary plate 10 comprises elongated openings 32 between webs 33, cf. FIGS. 2 and 5. In this manner any surplus material as well as material driven out by a cleaning brush 19 may fall down at either side of the metering groove 2 into an overflow hopper 23 and then into a collecting container 24, as shown in FIG. 4.

Figure 6:
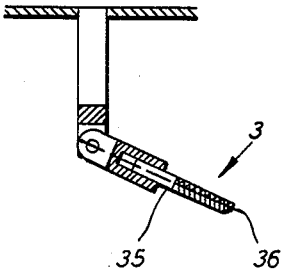
FIG. 6 is a view, partly in section, of a wiper means cooperating with the metering groove.

The bulk material cone forming of the laterally discharged excess material on the metering groove 2 which rotates under the vibrating feeder chute 1 and past the same first is sheared to a preselected bed level by a wiper means 3 including a wiper blade 36, as shown in detail in FIG. 6. Subsequently this material is compressed lightly and uniformly by a stationary compressing means 4 in the form of a rotatable compressing roll 4' acting by its own weight, as shown in detail in FIG. 7. The bulk material properties to be achieved hereby are such that the cross section of the metering groove 2 will be filled completely and evenly.

A rotating brush 5', cf. FIGS. 8 to 11 is provided as a predispersing means 5 downstream of the compressing roll 4' in the direction of movement of the metering groove 2, particularly if the material to be treated is not readily flowable. The brush is encapsulated in a housing 43, and air may be directed toward the same through an air inlet 40. This air serves to whirl up the previously steadied constant solid particle mass flow 8 from the metering groove 2 in front of a weir 41 which extends into the metering groove 2, thus to pass the flow into the suction mouth of a flow channel connected by a suction mouthpiece 42 to the housing 43 in the area of the brush 5', and to have the flow received and sucked off entirely by the suction mouthpiece. In this manner the solid particles are metered constantly into the flow channel.

Figure 12:
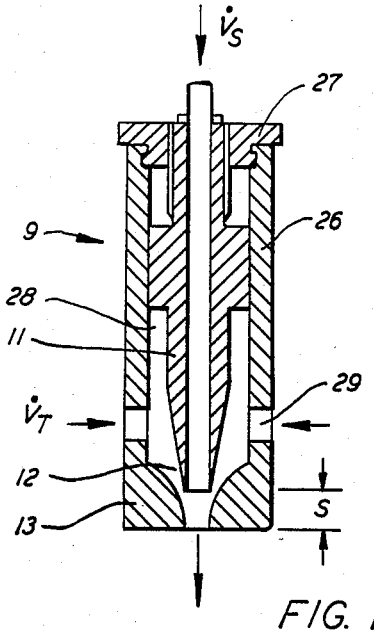
FIG. 12 is a longitudinal sectional elevation of the injector of the flow channel of the apparatus shown in FIG. 1, on an enlarged scale.

The flow channel consists of a suction channel 6, an injector 9, and an impact surface cascade 15 having an outlet nozzle 16. The injector shown in FIG. 12 comprises a hollow cylindrical housing 26 which is provided with a closure cap 27 and houses a longitudinally displaceable, conically tapering central tube 11 which is adapted to be connected to the suction channel 6 and through which the gas-solid mixture received from the metering groove 2 is advanced and discharged into an entry nozzle 13 formed in front of the opening of the tube. Together with the entry nozzle 13 the opening of the central tube 11 defines an annular gap 12. A propelling gas chamber 28 defined between the inner wall of the housing 26 and the outer wall of the central tube 11 receives propelling gas through gas inlet openings 29 formed in the wall of the housing 26 upstream of the opening of the central tube 11.

Figure 13:
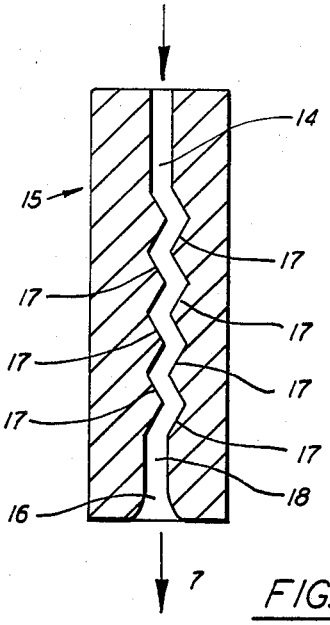
FIG. 13 is a longitudinal sectional elevation of an impact surface cascade of the apparatus shown in FIG. 1.
Figure 8:
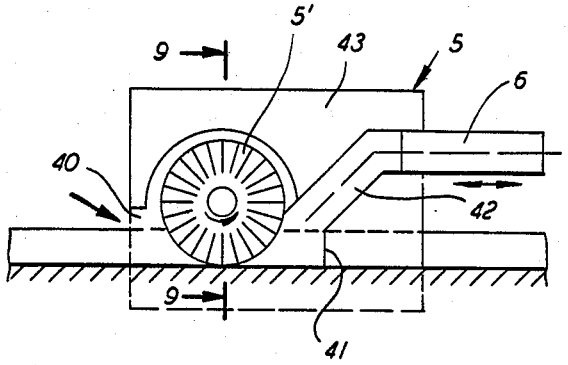
FIG. 8 is a sectional elevation along line 8—8 in FIG. 9 of a first embodiment of a predispersing means, including a brush which cooperates with the metering groove.
Figure 9:
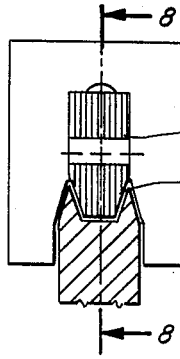
FIG. 9 is a sectional elevation along line 9—9 in FIG. 8 of the predispersing means and metering groove.

An impact surface cascade 15 as shown in FIG. 13 is connected directly to the injector 9 so as to achieve complete disagglomeration by means of particle-wall impacts which are purposefully effected. At the inlet end of the injector a straight mixing channel 14 is provided which is followed by a flat or rotationally symmetrical zig-zag-shaped channel section composed of impact surfaces 17 which are arranged one behind the other and disposed in zig-zag fashion at an angle of attack of from 20° to 70° with respect to the main direction of flow. These impact surfaces prevent the unobstructed passage of solid particles by extending at least so far into the free outlet cross section of the mixing channel 14 that the particles flowing into the impact surface cascade 15, when assumed to be continuing their movement in axial direction, do not find a free and unobstructed possibility of flowing through the cascade. Wall impacts which are unavoidable will break up great agglomerates, while particles which already are dispersed as well as the finest particles rather tend to flow around the impact surfaces. It may be necessary to give the impact surface outline an unsymmetrical design, depending on the material to be treated. Also, it may be necessary to roughen the impact surfaces 17 so as to promote the dispersing action. The dispersing capacity is increased because it is not only the angle of attack of the impact surfaces 17 which determines the particle-wall impacts but instead a whole spectrum of impact angles increasing the chances of dispersion still further. Having flown past the five impact surfaces shown in FIG. 13, the gas-solid flow passes through a channel portion 18 which is designed as an accelerator path and in which the dispersed solids are accelerated to almost the same final velocity. Then the flow exits from the impact surface cascade 15 through the outlet nozzle 16, thus leaving the (dispersing) flow channel as a free jet 7.

The dispersing begins as the solid mass flow 8 is received in the injector 9. The aspiration of the solid particles from the metering groove 2 of the rotary plate 10 and the increasing acceleration and mixing with conveying air as the material passes through the suction channel 6 and the injector 9 will cause the solid particles and agglomerates to be split up and separated. The propelling gas volume flow $V_T$ flowing in through the annular gap 12 at a pre-pressure $p_T$ of up to 10 bar induces a suction flow $V_S$ in the central tube 11 of the injector 9. The gap between the opening of the central tube 11 and the entry nozzle 13 which is adjustable to widths s of from a few millimeters to some tenths of a millimeter acts like a throttle on the propelling gas volume flow. The entry nozzle 13 will have the effect of accelerating the propelling gas flow loaded with particles to high speeds in the downstream mixing channel 14 so that, on the one hand, the necessary low pressure required for the suction performance of the suction channel 6 is created and, on the other hand, the forces of flow in the shear flow in the annular gap 12 will cause the solid particles available in the form of agglomerates to be exposed to shearing stress which will cause their dispersion. Additional dispersion is obtained from wall and particle impacts along the entire pneumatic transportation distance up to the exit from the injector 9. However, an intentional dispersing action by wall impacts at selected angles between 20° and 70° is obtained only in the impact surface cascade 15 downstream of the injector 9 and upstream of the outlet nozzle 16.

The flow velocities within the injector 9 and the impact surface cascade 15 always remain below 100 m/s so that no comminuting but dispersing alone is effected in the particle size range indicated of up to approximately 50 μm.

Experience has shown that sufficiently high degrees of dispersion are obtained for bulk material including solid particles of a size below 50 μm and even when containing considerable proportions of the finest particles, i.e. if, for example, up to 70% are smaller than 5 μm. With dispersing apparatus in which use is made only of the shear gradient of an injec flow and with which the flow passes through a straight tube, no more than 80% dispersion are achieved.

An arrangement of three impact surfaces 17 was found to be the optimum. At a sufficiently wide range of adjustment of the gap width s and pre-pressure $p_T$ an almost complete dispersion of rates between 97% and 100% can be achieved.

Favorable conditions as regards the aspiration as well as the shear gradient of the flow are obtained at narrow gap widths. Tests were made at a pre-pressure $p_T$ of 3 bar and a gap width s=1.5 mm. For this adjustment the volume flow ratio between the propelling jet and the suction jet is approximately 1 at idle running of the injector 9 without solids. Adaptations at greater or smaller mass flow rates are to be made by way of the geometry of the central tube 11 and of the propelling gas or air supply means 40, whereas the pre-pressure and gap widths remain largely uninfluenced.

The mode of operation of the apparatus will be understood from the example described below. The solid mass flow rate obtainable in the first place is determined by the number of revolutions of the rotary plate 10 which may be up to 100 r.p.m. and by the diameter and cross section of the metering groove 2. Investigations made by the inventors have shown that commercially available fine limestone may be processed at a mass flow rate of 10 kg/h and a mass flow rate variation of less than 4% at a speed of 10 r.p.m. and a diameter of 20 cm and a cross section of the metering groove of 12 $mm^2$. The metering means 22 supplies material in an excess of up to three times the amount. Two thirds at first remain on the metering groove 2. However, during the first steadying the wiper means 3 reduces the greater part of the resulting bulk material cone, while the compressing roll 4', in compressing the material, will produce only a minor additional reduction. Geometrical enlargements or reductions of the cross section of the metering groove 2 and of the dimensions of the rotary plate 10 permit an adaptation to greater or smaller ranges of mass flow rates.

Figure 3:
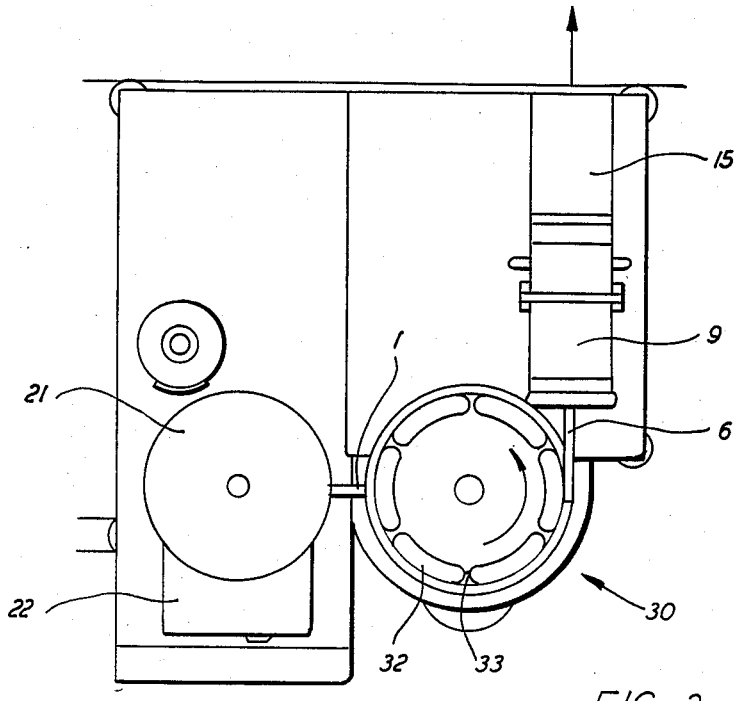
FIG. 3 is a top plan view of the complete metering-dispersing apparatus shown in FIG. 1, without the means disposed above the rotary plate.

FIGS. 2 to 4 are views of a metering-dispersing apparatus 30 which is applied as a combination of the means for generating a gas-solid-two phase jet, e.g. for the dry analysis of diffraction spectra to determine the particle size distribution in the solid particle shower. The particulate material to be analyzed is introduced into a supply or feeding hopper 21 of the metering means 22 and flows through the vibrating feeder chute 1 on to the metering groove 2 of the rotary plate 10. The coordination of the individual means, such as the wiper means 3, the compressing means 4, and the take-up and predispersing means 5 may be taken specifically from FIGS. 2 and 4 showing rotary plates 10 which rotate in clockwise sense and in counterclockwise sense, respectively. The direction of movement at the predispersing means 5 is the same as the direction of aspiration into the suction channel 6.

FIG. 5, showing a structural detail, illustrates the cross sectional surface 31 of the metering groove 2 of the rotary plate 10 and a structure of apertured spokes provided for the outflow of excess material and having oval openings 32 between the webs 33 of the rotary plate 10. The side walls 34 of the metering groove 2 which are steep and converge at the upper edge of the metering groove 2 guarantee that excess material can flow off without obstruction and that the compressing roll 4'' can roll off in defined manner to achieve compression without a second undesired solid bed forming on the front end surfaces of the side walls 34 of the metering groove 2.

FIG. 6 is an enlarged presentation of the wiper means 3 comprising a pivotable, rotatable blade holder 35 which is adapted to be arrested at different angles of attack and comprises a wiper blade 36.

Figure 7:
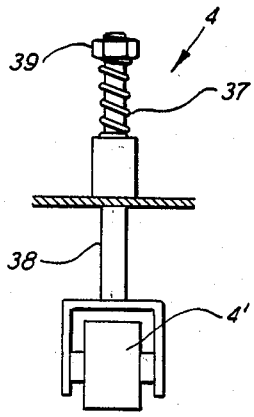
FIG. 7 is a diagrammatic view of the compressing means, including a compressing roll, cooperating with the metering groove.

FIG. 7 shows a compressing means 4 comprising a solid compressing roll 4' which has a high natural weight and an adjustable compression spring 37 to determine the compressing conditions. The compressing roll 4' is supported in a stirrup which is fixed to and guided by a vertical bar 38 and supported on the compression spring 37 by way of a nut 39 received in threaded engagement on the end of the bar. The compression spring in turn rests on a wall of a housing or carrier (not shown).

FIGS. 8 to 11 show a predispersing means 5 in the form of the rotating brush 5'. In the case of the embodiment shown in FIGS. 8 and 9 the rotating brush 5' is supported for rotation in the housing such that it extends completely into the metering groove 2 to take up the material being transported in its direction of rotation. The air supply means 40 guarantees that the suction channel 6 connected by way of the suction mouthpiece 42 will receive the material just above the upper edge of the metering groove and in predispersed condition in a sufficient amount of air. The housing 43 further comprises the weir 41 which closes the cross section of the metering groove 2 and is disposed downstream of the opening of the suction mouthpiece 42 in the direction of movement of the metering groove 2. Constant transfer of the mass flow into the suction mouthpiece 42 is safeguarded by the brush together with the weir.

Figure 10:
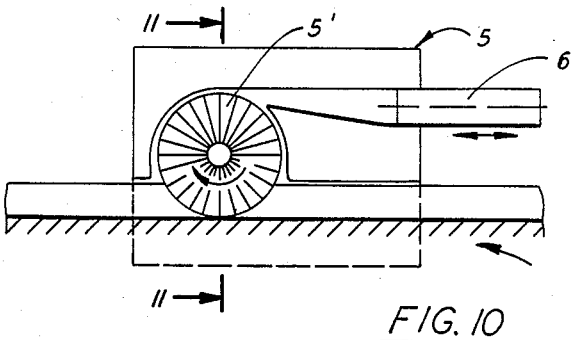
FIG. 10 is a sectional elevation along line 10—10 in FIG. 11 of a second embodiment of a predispersing means.
Figure 11:
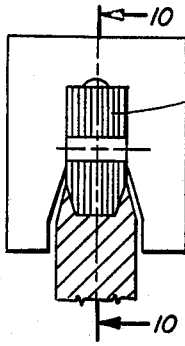
FIG. 11 is a sectional elevation along line 11—11 in FIG. 10 of the predispersing means and metering groove.

In the embodiment of the predispersing means shown in FIGS. 10 and 11 any greater supply of air is dispensed with just like a suction mouthpiece 42 coordinated directly with the metering groove. Instead, the suction channel 6 is connected close to the upper vertex of the brush 5' so that first the material is lifted from the metering groove to be subjected to predispersing. The brush 5' rotates contrary to the direction of conveyance of the solid mass flow, causing a deflection and the lifting to the level of the suction channel 6, with the support of aspired air. The aspiration of air is effected by the metering groove 2 which has been emptied of material to be treated. In this manner the inflowing air will enhance the reception of material. With both embodiments the housing 43 is sealed off against extraneous air and rests stationarily and largely sealed on the rotary plate 10 above the metering groove 2.

The cross section of the metering groove 2 formed in the rotary plate 10 may range in size from a few $mm^2$ up to some $cm^2$ so as to be adaptable to the particle size distributions and to cover a wide range of mass flow rates up to several 10 kg/h.

The dosing means 22 may comprise not only a vibrating feeder chute 1 as a means of transportation but also a screw conveyor, a fluidized bed chute, or any other known member.

Figure 14:
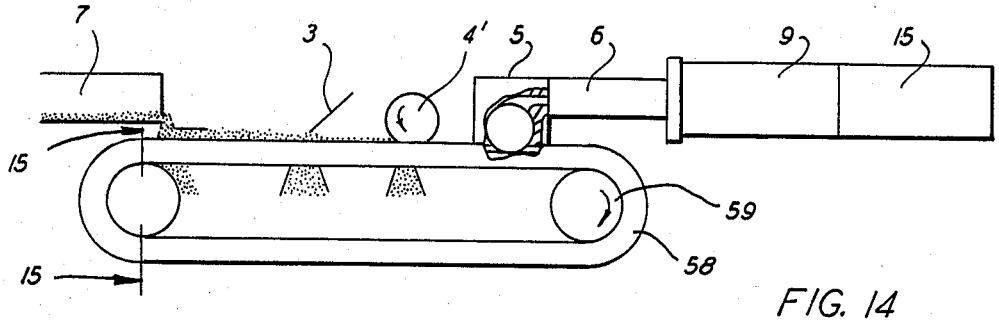
FIG. 14 is a view of a second embodiment of the metering-dispersing apparatus, having a conveyor belt which revolves about horizontal axes and has an outer merering groove.
Figure 15:
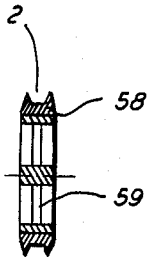
FIG. 15 is a cross sectional elevation along line 15—15 in FIG. 14 of the conveyor belt.
Figure 16:
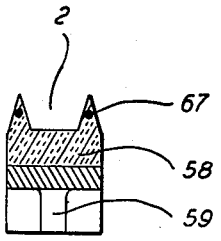
FIG. 16 is an enlarged cross sectional elevation along line 15—15 in FIG. 14 of the conveyor belt.

With the embodiment of a metering-dispersing apparatus 50 as shown in FIG. 14 the metering groove 2 is located at the outside of an endless conveyor belt 58 of V-belt type revolving around two guide rollers 59 which are arranged spaced apart horizontally. The guide roller 59 shown at the right hand side of the drawing is driven by a motor not shown specifically.

The conveyor belt has a horizontally moving upper run and a parallel lower run. The vibrating feeder chute 1 of the metering means 22 ends at the left end of the upper run of the conveyor belt, introducing into the metering groove 2 an excess of material to be metered. Again a wiper means 3 and a compressing means 4 including a compressing roll 4' are provided at the metering groove 2, spaced from the dispensing location. A predispersing means 5, including a brush 5' to receive the material from the metering groove 2 are disposed upstream of the right guide roller 59. The stability of the side walls 34 of the metering groove 2 is increased by steel bands 61 or any other stabilizing protective members.

The straight-line arrangement of the vibrating feeder chute 1, the wiper means 3, the compressing roll 4', and the brush 5' calls for very little lateral space. Thus it is possible to arrange several such metering-dispersing devices 50 slightly spaced from each other in side-by-side relation so that, with corresponding design of the outlet nozzle 16, the issuing free jets 7 can combine in a common, wide, continuous free jet having the shape of a broad flat jet 53. The compressing rolls 4', the brushes 5', and the right guide rollers 59 each may be driven by common, continuous drive shafts 62. The excess material removed from the metering groove 2 again falls into a common overflow hopper 60 to be returned to the feed hoppers 21 of the metering means 22. The mutual spacing between the plurality of devices 50 is determined by the exit angle of the free jets 7 and the distance of the working plane 54 of the wide flat jet 53 from the plane 55 of the openings of the outlet nozzles 16.

In a third embodiment of the metering-dispersing apparatus 75, as shown in FIGS. 18 to 21, the metering groove 2 is formed in the inside of a wheel rim 63 of a wheel which is rotatable about a horizontal axis of rotation and which has spokes 65 disposed obliquely with respect to a hub 64. As the wheel rotates about a horizontal axis, the wheel rim 63 is disposed vertically. With this embodiment the material again can be fed into the metering groove 2 in the area of the lowest point thereof, using a vibrating feeder chute. However, in this case it is preferred to effect the feeding by a fluidized bed means 66 including a box 67 which is open at the top and the lower portion of which is separated from its upper portion by a screen 68. Below the screen 68 the lower portion is designed as an air box into which air inlets 69 open from the sides. The material to be charged is introduced in per se known manner on the upper side of the screen 68. Upon supply of a sufficient quantity of air through the air inlets 69 a fluidized bed is formed above the screen 68. The fluidized bed means 66 is coordinated with the wheel rim 63 in such manner that the wheel rim will be immersed into the fluidized bed 71 by its respective lower segment 70. This will permit the particles to enter laterally into the metering groove 2, thereby filling the same. As the wheel rim rotates at an elevated number of revolutions and the metering groove 2 is furnished at the inside with ribs 72 to promote the entrainment of the material, the material is lifted out of the fluidized bed. Any excess material again is sheared off by a wiper means 3 and compressed by a compressing roll 4' before a brush 5' will deliver the material into the suction mouth of the suction channel 6 near the upper vertex, in the case of the embodiment shown in FIG. 18. Again an injector 9 and an impact surface cascade 15 constituting the flow channel are connected to the suction channel. The number of revolutions of the wheel rim 63 is so selected that the material will be taken along up to the brush 5'.

Figure 20:
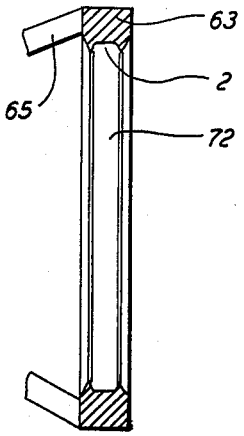
FIG. 20 is a cross sectional elevation of the wheel rim of the apparatus shown in FIG. 18.
Figure 22:
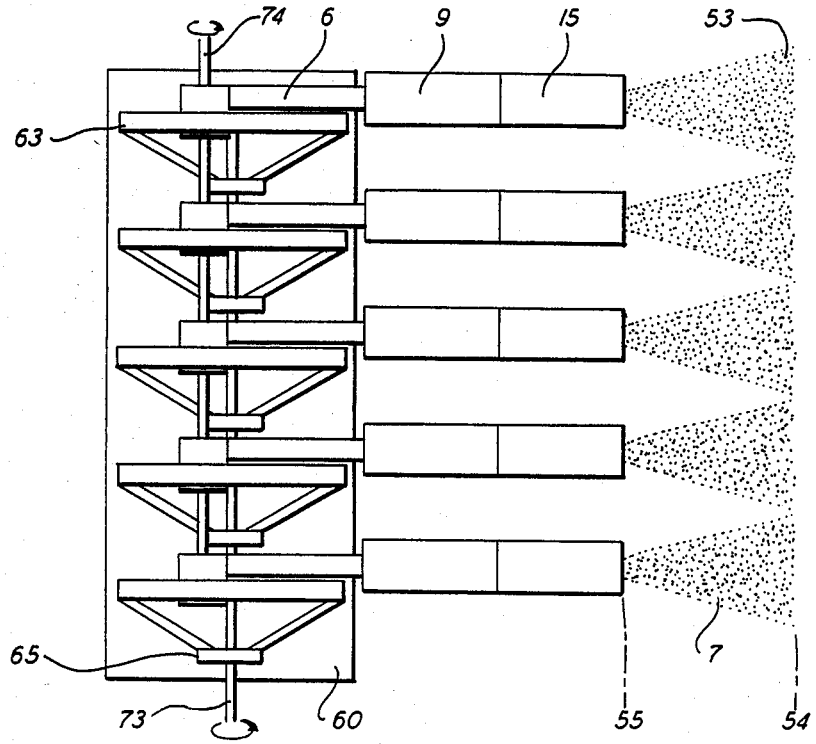
FIG. 22 is a top plan view of five apparatus as shown in FIGS. 18 to 21, arranged in parallel.

In a modified embodiment as illustrated in FIG. 20, the number of revolutions is lower so that the material will leave the metering groove 2 before the upper vertex is reached and will fall freely as a solid particle mass flow 76 into a collecting funnel 77 of the suction channel 6.

The wiper means 3, the compressing means 4, and the predispersing means 5 may be distributed at the inner radius along the entire circumference of the wheel rim 63, depending on the product, the number of revolutions, and the corresponding centrifugal forces. In special cases the material may be received by the suction channel 6 without any predispersing means 5, and the transfer, particularly at the vertex may be effected by free falling under gravity. Where material is readily flowable it is even possible to utilize the so-called "cataracting" behavior of material which has not been fully centrifuged, such as known from tube mills, disc pelletizers, and the like. In this manner the solid particle mass flow 76 will be taken over upon free fall into the collecting funnel 77 even if it is separated from the metering groove before reaching the vertex. The forced feed out of the fluidized bed then makes it particularly convenient, if not necessary to provide the metering groove 2 with webs or ribs. With this arrangement the material may be taken over into the horizontal injector 9 either in parallel with or perpendicularly to the axis of rotation of the wheel rim 63. The end surface of the wheel rim facing the injector 9 must remain freely accessible so that the drive means must be disposed at the opposite side and lead out of the range of the fluidized bed. This is what the oblique spokes 65 are provided for.

Figure 17:
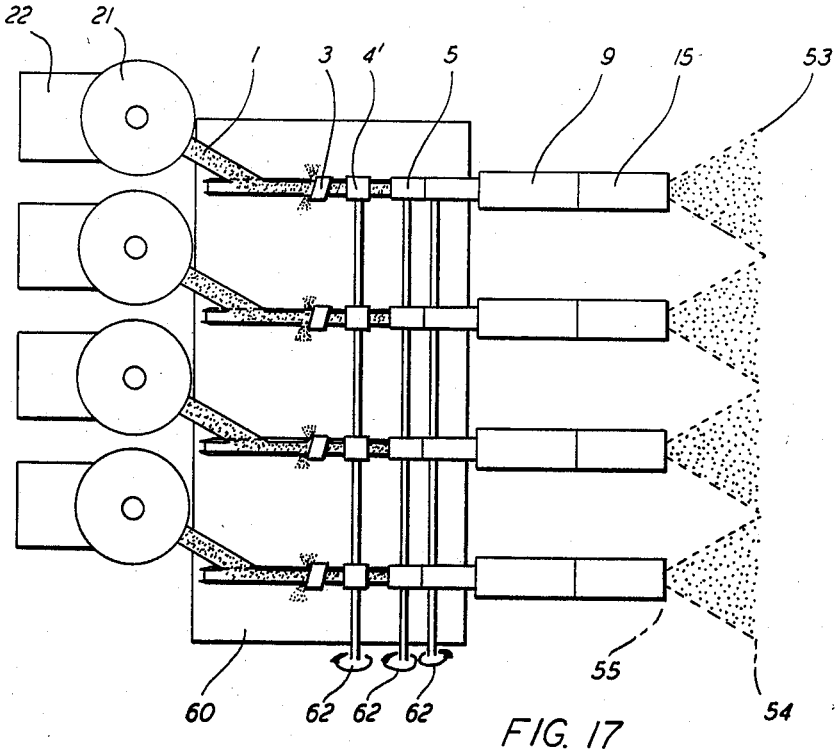
FIG. 17 is a top plan view of four apparatus as shown in FIG. 14, arranged in parallel to produce a wide flat jet.
Figure 18:
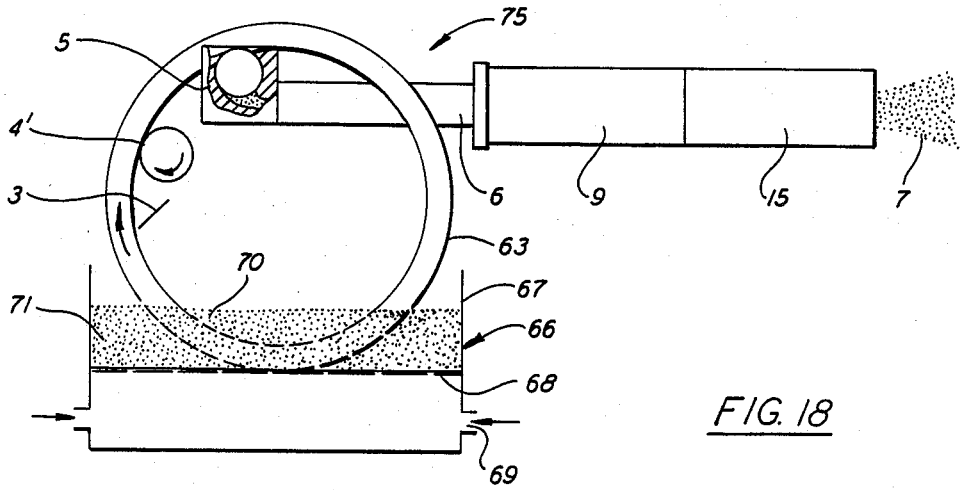
FIG. 18 is a view of a third embodiment of the metering-dispersing apparatus, having a wheel rim with an inwardly disposed metering groove.
Figure 19:
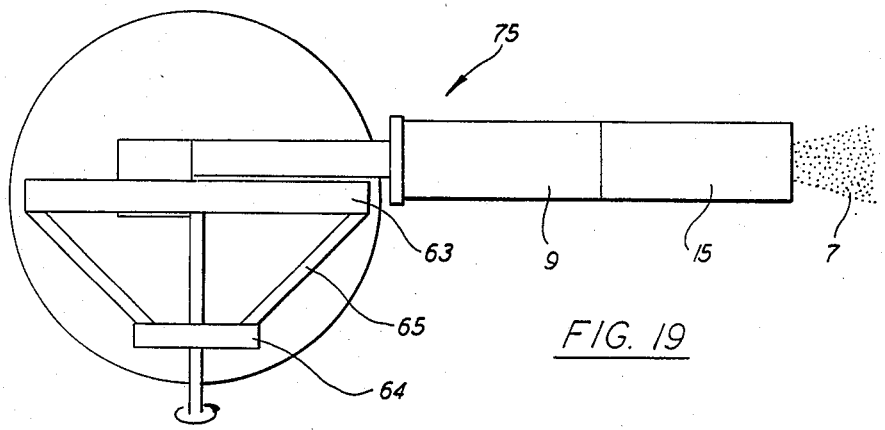
FIG. 19 is a top plan view of the apparatus shown in FIG. 18.
Figure 21:
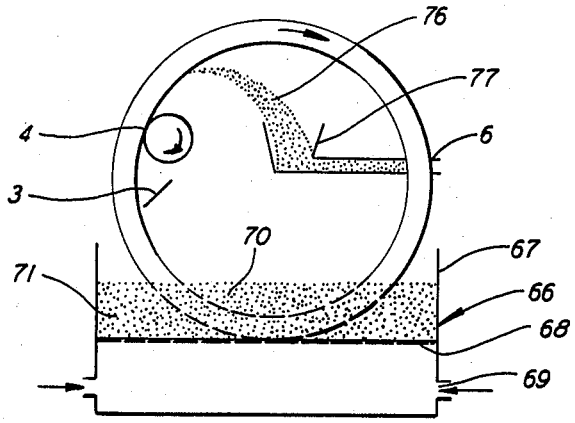
FIG. 21 is a cross sectional elevation of the wheel rim of the apparatus shown in FIG. 18, with modified delivery of material.

In a multiple assembly to produce a wide flat jet 53 a plurality of metering-dispersing devices 65 may be disposed coaxially so that again common drive shafts 73 may be provided for all wheel rims 63 as well as common drive shafts 74 for the compressing rolls and the cylindrical brushes, if desired, cf. FIG. 21. The same considerations explained with respect to the multiple arrangement shown in FIG. 17 also apply to the spacing between the individual devices 75.

Figure 23:
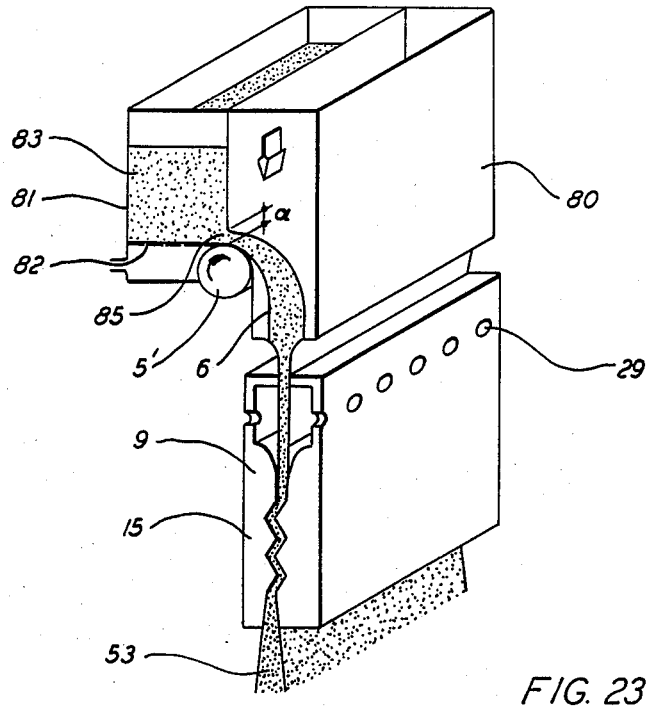
FIG. 23 is a perspective view of a fluidized bed means replacing the rotary metering groove.

A metering-dispersing means as shown in FIG. 23 also may be used to provide a broad flat jet. A solid particle mass flow of constant mass or volume flow rate is fed directly into a so called plane, i.e. elongated flat flow channel which has a width of the flat jet 53 to be produced. The suction channel 6 which is formed in a block 80 parallel to the fluidized bed duct 81, the injector 9, and the impact surface cascade 15 of the flow channel all are flat, i.e. they are linear and oblong and as wide as the flat jet 53 to be provided, to the hight of which they are proportional, as shown diagrammatically in FIG. 23. Upstream of the flow channel an elongated fluidized bed duct 81 takes care of the constant mass or volume flow rate feeding, a metering means supplying the material into the duct. A lower portion of the box-like housing of the fluidized bed duct into which the carrier fluid, in particular air is introduced, is separated from the upwardly open portion by a screen 82. At the lower right hand portion edge, as seen in FIG. 23, of the fluidized bed 83 forming in operation, there is a slot-like outlet opening 85 which is situated just above the sreen 83 and into which the suction channel is connected. In the embodiment shown the suction channel 6 is curved in downward direction. In the lower wall of the suction channel at the suction mouth, furthermore, there is a cylindrical metering brush 5' which may be replaced by a metering roller as well. The spacing a of the brush from the opposite wall, being the top wall in FIG. 23, of the flat suction channel 6 and/or the number of revolutions of the brush is/are adjustable for control of the particle mass flow issuing from the fluidized bed 83. In this embodiment no excess material is fed on a rotating metering groove, as was the case with the other embodiments. Despite of variations in the metering of the material to be treated a flow of constant mass or volume flow rate is delivered from the fluidized bed 83 and sucked directly into the suction channel 6 to be dispersed into the flat injector and the downstream impact surface cascade 15. The resulting wide flat jet 53 is homogeneous as soon as it has issued from the outlet nozzle 16.

What is claimed is:

1. A metering-dispersing apparatus for producing a gas-solid two phase flow jet having a constant flow rate and predetermined velocity, with the solids being fully and uniformly dispersed therein, comprising:

(a) means forming a metering groove which is rotatable about an axis, said metering groove having a cross section to establish a consolidated solid particle mass flow of constant cross section;

(b) metering means including a vibrating feeder chute having a dispensing location spaced above the metering groove for feeding solid particles to said metering groove;

(c) wiper means disposed downstream of the dispensing location of the metering groove as seen in the direction of rotation of said metering groove and at an adjustable distance from said metering groove for the selected removal of surplus solids;

(d) means for compressing the solids remaining in solid groove, after passing said wiper means, disposed downstream of said wiper means in the direction of rotation of said metering groove for uniformly and lightly compressing the solid particles in said metering groove; and (e) a flow channel including:

(i) an injector having a suction mouth immersed in said metering groove downstream of said compressing means in the direction of rotation of said metering groove;

(ii) dispersing means following said injector and including a plurality of impact surfaces having a zig-zag outline within said flow channel arranged to be hit successively by the gas-solid particle mixture moving from said injector to said dispersing means; and (iii) an outlet nozzle downstream of said plurality of impact surfaces.

2. Apparatus as claimed in claim 1, wherein said zig-zag outline of said impact surface cascade is unsymmetrical.

3. Apparatus as claimed in claim 1, wherein said impact surfaces are roughened.

4. Apparatus as claimed in claim 1, wherein said injector comprises:

(a) a propelling gas chamber;

(b) a central tube disposed within said gas chamber;

(c) an entry nozzle into said dispensing means formed at the end of said gas chamber, said central tube having an end spaced from said nozzle and forming therewith an annular gap, said impact surfaces of said dispersing means disposed downstream of said entry nozzle.

5. Apparatus as claimed in claim 4, wherein the distance between the mouth of said central tube and said entry nozzle is adjustable between a few millimeters and some tenths of a millimeter.

6. Apparatus as claimed in claim 5, wherein said central tube is supported for longitudinal displacement.

7. Apparatus as claimed in claim 1, and further including redispersing means for loosening the compressed solid particles extending into said metering groove upstream of the suction mouth of the flow channel.

8. Apparatus as claimed in claim 7, wherein said predispersing means comprises a revolving brush.

9. Apparatus as claimed in claim 7, and further including a gas supply means associated with said predispersing means.

10. Apparatus as claimed in claim 1, and further including a straight channel portion designed as an accelerator path between said impact surfaces and said outlet nozzle.

11. Apparatus as claimed in claim 1, wherein said metering groove comprises an upwardly open groove in the top surface of a rotary plate which is rotatable about a vertical axis.

12. Apparatus as claimed in claim 1, wherein said metering groove is formed in the inside of a wheel rim which is rotatable about a horizontal axis of rotation, the metering groove facing said axis of rotation.

13. Apparatus as claimed in claim 12, wherein said wheel rim is rotatable at such a high number of revolutions that the solid particles delivered to it are held completely in the metering groove by centrifugal force.

14. Apparatus as claimed in claim 12, wherein the wheel rim is rotatable at such a high number of revolutions that the solid particles, upon reaching the vertex, will separate from the metering groove to be transferred directly into the suction mouth of the flow channel.

15. Apparatus as claimed in claim 12, wherein said wheel rim is rotatable at such a high number of revolutions that the solid particles, prior to reaching the vertex, will fall back in cataract fashion, falling freely out of the metering groove into a collecting funnel disposed at the suction mouth of the flow channel.

16. Apparatus as claimed in claim 12, wherein the metering groove is provided with transverse webs to enhance the conveying of the solid particles.

17. Apparatus as claimed in claim 12, wherein the metering means comprises a fluidized bed means having an upwardly open box into which a lower segment of said wheel rim is immersed to such an extent that the metering groove becomes filled from the side.

18. Apparatus as claimed in claim 1, wherein the metering groove is formed in the outside of an endless conveyor belt revolving around two guide rollers which are supported horizontally spaced from each other, and wherein said wiper means, compressing means, and the suction mouth of the flow channel cooperate with the upper horizontal belt run.

19. Apparatus as claimed in claim 12 or 18, wherein a plurality of feeding-dispersing devices are arranged in parallel so as to provide a wide uninterrupted flat jet, the issuing free jets combining in a broad flat jet at a predetermined spacing from the opening plane of the outlet nozzles.

20. A metering jet-dispersing apparatus for producing a gas-solid two phase flow jet having a constant flow rate and predetermined velocity, with solids being fully and uniformly dispersed therein comprising:

(a) means for metering a consolidated solid particle mass flow of constant cross section including:
  (i) a screen adapted to be penetrated by a carrier gas;
  (ii) a fluidized bed disposed above said screen, said fluidized bed having a metering groove, said metering groove having a lower edge disposed directly above said screen; and
(b) a planar flow channel having an oblong cross section, including:
  (i) an injector;
  (ii) a suction channel coupling said fluidized bed to said injector;
  (iii) dispersing means; and an outlet nozzle for forming a flat jet, said dispersing means including a plurality of impact surfaces to be hit successively by the gas-solid particle mix disposed in said flow channel upstream of the outlet nozzle.

21. Apparatus according to claim 20, and further including a cylindrical metering brush or roll for adjusting the particle flow rate arranged at the inlet into said suction channel, the distance of which with respect to its opposing wall is adjustable.

22. The apparatus as claimed in claim 20, wherein said impact surfaces are arranged in a cascade of zig-zag outline.

* * * * *

UNITED STATES PATENT AND TRADEMARK OFFICE

CERTIFICATE OF CORRECTION

PATENT NO. : 4,573,801

DATED : March 4, 1986

INVENTOR(S) : LESCHONSKI, et al.

It is certified that error appears in the above-identified patent and that said Letters Patent is hereby corrected as shown below:

| Column | Line | |
|---|---|---|
| 1 | 12 | Change "free" to --flow--. |
| 3 | 8 | Change "millimeter" to --millimeters--. |
| 4 | 34 | Change "heigth" to --height--. |
| 7 | 54 | Change "are" to --is--. |
| 8 | 32 | Change "on to" to --onto--. |
| 11 | 35 | Change "hight" to --height--. |
| 11 | 48 | Change "sreen" to --screen--. |
| 11 | 60 | Change "Despite of" to --Despite--. |

In the Claims

| Claim | Line | |
|---|---|---|
| 1 | 19 | Change "solid groove" to --said metering groove--. |
| 7 | 60 | Change "redispersing" to --predispersing--. |

Signed and Sealed this

Eleventh Day of August, 1987

*Attest:*

DONALD J. QUIGG

*Attesting Officer*

*Commissioner of Patents and Trademarks*